US010701988B2

(12) United States Patent
Pfanner

(10) Patent No.: US 10,701,988 B2
(45) Date of Patent: Jul. 7, 2020

(54) GARMENT, PARTICULARLY A PROTECTIVE VEST, AND ZIPPER ARRANGEMENT

(71) Applicant: Pfanner Schutzbekleidung GmbH, Koblach (AT)

(72) Inventor: Anton Pfanner, Hohenems (AT)

(73) Assignee: PFANNER SCHUTZBEKLEIDUNG GMBH, Koblach (AT)

( * ) Notice: Subject to any disclaimer, the term of this patent is extended or adjusted under 35 U.S.C. 154(b) by 75 days.

(21) Appl. No.: 15/754,240

(22) PCT Filed: Mar. 17, 2017

(86) PCT No.: PCT/EP2017/056412

§ 371 (c)(1),
(2) Date: Feb. 21, 2018

(87) PCT Pub. No.: WO2017/158169

PCT Pub. Date: Sep. 21, 2017

(65) Prior Publication Data

US 2018/0235290 A1 Aug. 23, 2018

(30) Foreign Application Priority Data

Mar. 17, 2016 (DE) ..... 10 2016 105 007

(51) Int. Cl.

| | |
|---|---|
| ***A41D 1/04*** | (2006.01) |
| ***A41D 15/00*** | (2006.01) |
| ***A44B 19/24*** | (2006.01) |

(52) U.S. Cl.

CPC ..... *A41D 1/04* (2013.01); *A41D 15/00* (2013.01); *A41D 15/002* (2013.01); *A44B 19/24* (2013.01);

(Continued)

(58) Field of Classification Search

CPC ..... A41D 13/00; A41D 15/002; A41D 15/00; A41D 2300/20; A41D 2300/322; A44B 19/24

See application file for complete search history.

(56) References Cited

U.S. PATENT DOCUMENTS 1,010,679 A * 12/1911 Padernacht ..... A41D 1/02 2/93
1,927,179 A 9/1933 Levinsohn (Continued)

FOREIGN PATENT DOCUMENTS

CA 2 652 174 A1 8/2010
CA 2977815 A1 9/2017

(Continued)

OTHER PUBLICATIONS

International Search Report for PCT/EP2017/056412 dated Jun. 6, 2017 (6 Pages).

*Primary Examiner* — Shaun R Hurley
*Assistant Examiner* — Bao-Thieu L Nguyen
(74) *Attorney, Agent, or Firm* — Fitch, Even, Tabin & Flannery, LLP

(57) ABSTRACT

An article of clothing, in particular a protective vest, the size of which can be adjusted. At least one outer zipper with two rows of teeth is provided. The article of clothing has a first size in a closed state of the outer zipper and a second size in an open state of the outer zipper, wherein the first size is smaller than the second size. In the open state of the outer zipper, the rows of teeth are held together at a distance from each other by material which is at least partly covered by the outer zipper in the closed state of the outer zipper. An inner zipper with two rows of teeth is provided, said zipper being at least partly covered by the outer zipper in the closed state of the outer zipper and being exposed in the open state of the outer zipper.

9 Claims, 4 Drawing Sheets

(52) U.S. Cl.
CPC .... *A41D 2300/20* (2013.01); *A41D 2300/322* (2013.01)

(56) References Cited

U.S. PATENT DOCUMENTS

| | | | | |
|---|---|---|---|---|
| 2,293,444 | A | 1/1940 | Muccillo | |
| 2,636,176 | A * | 4/1953 | Ross | A41D 3/02 2/93 |
| 3,110,903 | A * | 11/1963 | Burchard | A41D 1/08 2/221 |
| 3,230,545 | A | 1/1966 | Galley | |
| 3,584,323 | A * | 6/1971 | Worley | A47G 9/086 5/413 R |
| 3,665,516 | A | 5/1972 | Orovan | |
| 3,771,169 | A | 11/1973 | Edmund | |
| 4,574,397 | A * | 3/1986 | Dennard | A41D 15/04 2/126 |
| 5,033,127 | A | 7/1991 | Schmeltz | |
| 6,058,508 | A * | 5/2000 | Brown Honeysuckle | A41D 15/002 2/69 |
| 6,792,621 | B2 * | 9/2004 | Braun | A41D 27/285 2/1 |
| 6,961,962 | B1 | 11/2005 | Lewis | |
| 7,832,022 | B1 * | 11/2010 | Peters | A41D 1/08 2/227 |
| 10,100,679 | B2 | 10/2018 | Geveci et al. | |
| 2003/0126667 | A1 | 7/2003 | Braun et al. | |
| 2004/0111783 | A1 * | 6/2004 | Lee | A41D 1/00 2/93 |
| 2004/0143884 | A1 | 7/2004 | Majerfeld | |
| 2004/0209018 | A1 * | 10/2004 | Lookholder | A41D 15/00 428/33 |
| 2006/0107434 | A1 * | 5/2006 | Rowe | A41D 13/12 2/69 |
| 2006/0277653 | A1 | 12/2006 | Okajima | |
| 2007/0266472 | A1 * | 11/2007 | DuFaux | A41B 13/005 2/80 |
| 2008/0086794 | A1 * | 4/2008 | Gardner, III | A41D 1/21 2/237 |
| 2009/0265829 | A1 | 10/2009 | Gomes Seguin et al. | |
| 2010/0127025 | A1 | 5/2010 | Kelling | |
| 2010/0168636 | A1 * | 7/2010 | Allard | A61F 5/0111 602/62 |
| 2011/0185476 | A1 * | 8/2011 | Boisseau | A41D 1/08 2/243.1 |
| 2012/0096622 | A1 * | 4/2012 | Johnson | A41D 15/00 2/93 |
| 2014/0245519 | A1 * | 9/2014 | Ly | A44B 19/26 2/93 |
| 2016/0008178 | A1 | 1/2016 | Babic et al. | |
| 2018/0255843 | A1 * | 9/2018 | Paredes | A41D 1/06 |
| 2018/0255853 | A1 * | 9/2018 | Spathas | A41D 15/00 |

FOREIGN PATENT DOCUMENTS

| | | | |
|---|---|---|---|
| CA | 2996712 | A1 | 9/2017 |
| CN | 2245866 | Y | 1/1997 |
| CN | 202168458 | U | 3/2012 |
| CN | 202873836 | U | 4/2013 |
| CN | 203302369 | U | 11/2013 |
| CN | 203676320 | U | 7/2014 |
| CN | 205106439 | U | 3/2016 |
| DE | 298 02 758 | U1 | 6/1999 |
| DE | 102 49 196 | A1 | 7/2003 |
| DE | 10 2004 034 654 | A1 | 1/2006 |
| JP | S5842109 | U | 3/1983 |
| JP | H01 177223 | U | 12/1989 |
| JP | H0596009 | U | 12/1993 |
| JP | 3021748 | U | 3/1996 |
| JP | 2007236659 | | 9/2007 |
| KR | 2009 0127794 | A | 12/2009 |

* cited by examiner

GARMENT, PARTICULARLY A PROTECTIVE VEST, AND ZIPPER ARRANGEMENT

CROSS-REFERENCE TO RELATED APPLICATIONS

This application is a U.S. national phase application filed under 35 U.S.C. § 371 of International Application No. PCT/EP2017/056412, filed Mar. 17, 2017, designating the United States, which claims priority from German Patent Application No. 10 2016 105 007.5, filed Mar. 17, 2016, which are hereby incorporated herein by reference in their entirety for all purposes.

FIELD

The invention relates to a garment, particularly a protective vest, which is adjustable in its size, wherein at least one outer zipper having two rows of teeth is provided, wherein the garment has a first size in a closed state of the outer zipper and a second size in an opened state of the outer zipper, wherein the first size is smaller than the second size, and wherein, in the opened state of the outer zipper, the rows of teeth are held together at a distance by material covered, at least partly, by the outer zipper in the closed state of the outer zipper.

The invention further relates to a zipper arrangement.

BACKGROUND

Garments adjustable in size are known in numerous variants. This also applies to protective vests. The term "protective vest" is to be understood in its most general sense here. It includes warning vests, safety vests, working vests, etc., to name only a few examples of protective vests. Adjustability in size in currently known protective vests is, for example, provided by hook-and-loop fasteners being fixable in different positions. This is, as such, an implementable solution, such protective vests, however, being comparably complex in manufacturing. Further, adjusting hook-and-loop fasteners may be difficult or troublesome. Also, hook-and-loop fasteners tend to lose their functionality with time under unfavourable conditions.

In addition, the documents DE 10 2004 031 654 A1, DE 298 02 758 U1, DE 102 49 196 A1, US 2008/0086794 A1 and CN 205106439 U describe garments adjustable in size by means of zippers.

The invention is based on the object to provide a garment adjustable in its size which is easy to manufacture, can be effortlessly converted into the various size adjustments, and exhibits no or hardly any wear in the area of the means for size adaptation.

Said object is solved by the features of the independent claim.

Advantageous embodiments of the invention are specified in the dependent claims.

SUMMARY

The invention is based on the generic garment adjustable in its size in that an inner zipper having two rows of teeth is provided which is at least partly covered by the outer zipper in the closed state of the outer zipper and which is exposed in the opened state of the outer zipper and that the garment has the second size in a closed state of the inner zipper and a third size in an opened state of the inner zipper, wherein the second size is smaller than the third size, and wherein the rows of teeth of the inner zipper are held together at a distance in the opened state of the inner zipper by material at least partly covered by the inner zipper in the closed state of the inner zipper. Here, the adjustability in size is also provided for by a plurality of zippers. The manufacturing of garments having zippers is easy and low in cost. Further, zippers of appropriate quality have an extremely long service life. Based on the invention, the garment can be effortlessly adjusted in its size. The only thing that needs to be done is to open a zipper, and immediately a larger garment is available. The other way round, the only thing that needs to be done is to close a zipper to make the garment smaller. Particularly with regard to protective vests the simple adjustability in size is of special advantage since protective vests are worn above other garments having different volumes. In summer, a protective vest will possibly be worn above nothing more than a shirt so that a small size of the protective vest is sufficient while in winter it may be required to put on the protective vest, for example, above a voluminous down jacket. Apart from the advantage that, owing to the different sizes of one and the same protective vest, different garments of the same wearer are admissible, it is also so that one and the same protective vest may be used for persons having different dress sizes. This rationalises the manufacturing process, and it provides for a significant facilitation of storage and distribution. The garment according to the invention may, for example, also be an identification vest or a vest with a number, for example for competitions. It is particularly advantageous that a plurality of zippers are superposed, namely an outer and an inner zipper. After the outer zipper was opened for the transition from a first size (the smallest size) to a second size, a transition to a third size (which is larger than the second size) is possible by also opening the inner zipper. Thus, not only two different sizes of the garment are available. The term "covered" is no definition in the strictly geometrical sense so that, for example, the zipper would have to be superposed by the row of teeth in any projection. What is meant is rather that the row of teeth is covered by whatever. This applies to all embodiments of the present disclosure.

Further, it may be contemplated that, in the opened state of the outer zipper and in the opened state of the inner zipper, at least one of the rows of teeth of the outer zipper can be coupled with at least one of the rows of teeth of the inner zipper in the way of a zipper. By coupling one row of teeth of the outer zipper with the other row of teeth of the inner zipper, rather another size can be made available which is an intermediate size.

The invention can be further developed in that another inner zipper having two rows of teeth is provided or in that a plurality of further inner zippers having two rows of teeth are provided, wherein respectively adjacent inner zippers are interrelated like the outer zipper and the inner zipper directly following the outer zipper. So if, for example, exactly one outer and one inner zipper are present, apart from the smallest size with the outer zipper closed, two additional sizes are adjustable by only opening the outer and opening the inner zipper. If the rows of teeth of the zippers are then combined among each other, at least one additional size of the garment can be made available. Altogether, a plurality of superposed zippers can be made available. Opening the respectively next zipper which was just exposed by opening the zipper disposed above it will then afford another size of the garment. The rows of teeth of the individual zippers may all or in part be coupleable among each other in the way of a zipper so that intermediate sizes can be provided. To this end, the rows of teeth which can be coupled with each other need to be "identical in design". However, it is also possible to provide different zippers the rows of teeth of which are all or in part not identical in design and cannot be coupled. For example, a broader zipper can be used on the outside while zippers arranged on the inside are narrower. In this way, material can be saved, and the one or more inner zippers will become less bulky.

It may also be contemplated that, instead of one or more of the inner zippers, one or more rows of teeth are provided which do not necessarily have to be coupleable among each other in the way of a zipper, wherein these rows of teeth can, however, be coupled with at least one row of teeth of the outer zipper and/or an inner zipper in the way of a zipper. If, for example, an arrangement of only one outer zipper, no inner zipper, and only one single row of teeth which is completely or partly covered by the outer zipper in the closed state of the same is concerned a transition from a small size to a large size can be realised by opening the outer zipper. Since no other zipper is present, no larger size can be realised. However, the row of teeth provided on the inside can be coupled with one of the rows of teeth of the outer zipper. In this way, an intermediate size will be generated. A plurality of rows of teeth can be provided adjacent to each other to provide for a plurality of intermediate sizes.

It may further be contemplated that a zipper arrangement is provided by the zipper(s) and/or rows of teeth, and that zipper arrangements are provided in a plurality of positions of the garment. For example, it may be contemplated that, in protective vests, a zipper arrangement is disposed on each side of the protective vest, respectively.

In this connection it may be useful that the zipper arrangements are, at least partly, identical in design. All zipper arrangements will then have the same functionality.

However, it may also be useful that the zipper arrangements are, at least partly, different in design. In laterally provided zipper arrangements of protective vests, for example, one of the sides may be more complex in design than the other. This is particularly useful where the vest has other functional features which might impose constraints on the design of the zipper arrangements.

The invention also consists in a zipper arrangement suitable for use in a garment according to the invention and defined in connection with the garment according to the invention.

According to the invention, therefore, the known principle of size adjustment by means of zippers is advantageously expanded. This is achieved by one or more zippers arranged on the inside or by one or more rows or teeth arranged on the inside or by a combination of these. The inner rows of teeth, be it single rows of teeth or rows of teeth of zippers, can be combinable with rows of teeth of other zippers which requires rows of teeth of identical design. This, however, is not necessary if the adjustment of intermediate sizes is dispensed with.

The invention will now be explained by way of example in connection with preferred embodiments with reference to the accompanying drawings.

BRIEF DESCRIPTIONS OF THE DRAWINGS

DETAILED DESCRIPTION

Figure 1:
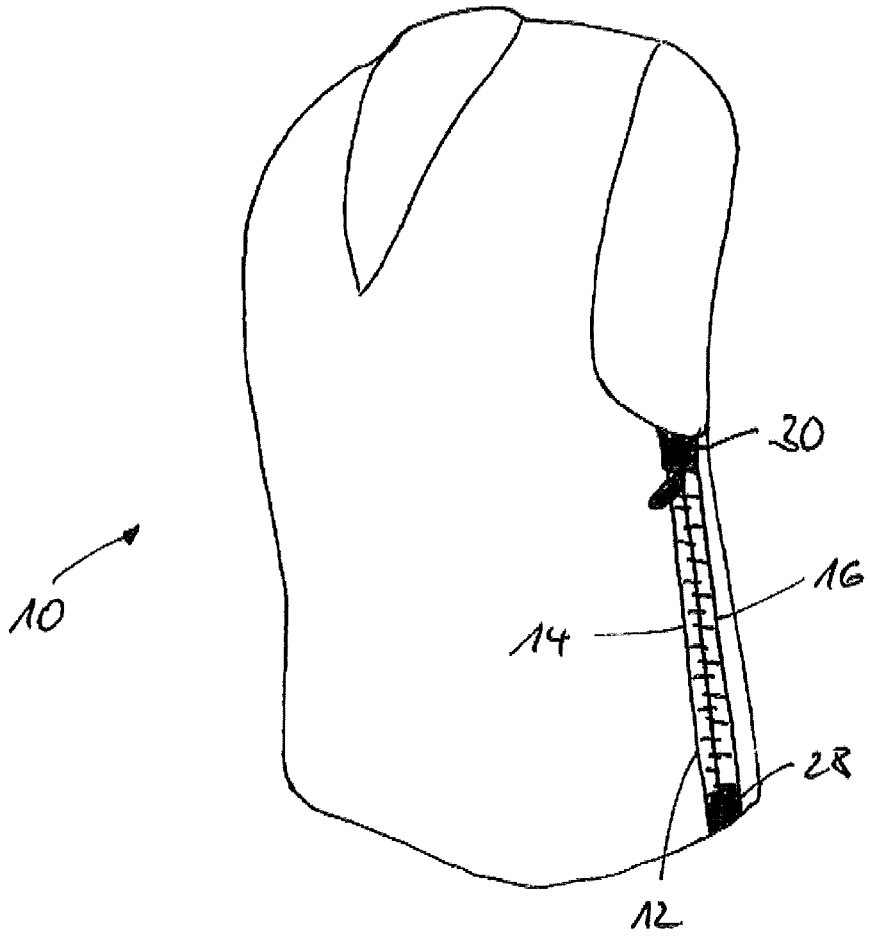
FIG. 1 shows a garment according to the invention in a first state.

FIG. 1 shows a garment 10 according to the invention in a first state. The garment 10 is a vest. The garment 10 is provided with a zipper arrangement, only an outer zipper 12 being visible in the illustration of FIG. 1. Further components of the zipper arrangement are covered by the zipper 12 or the material of the garment 10 adjacent to the zipper 12. The zipper 12 comprises two rows of teeth 14, 16, an end piece 28 and a slider 30. The zipper extends from an arm opening of the garment 10 to the lower edge of the garment 10. In the closed state, the slider 30 is positioned at the arm opening while the end piece 28 is located at lower edge. It is likewise possible to apply the zipper 12 the other way around so that the end piece 28 is located at the arm opening, and the slider 30 is positioned at the lower edge of the garment.

Figure 2:
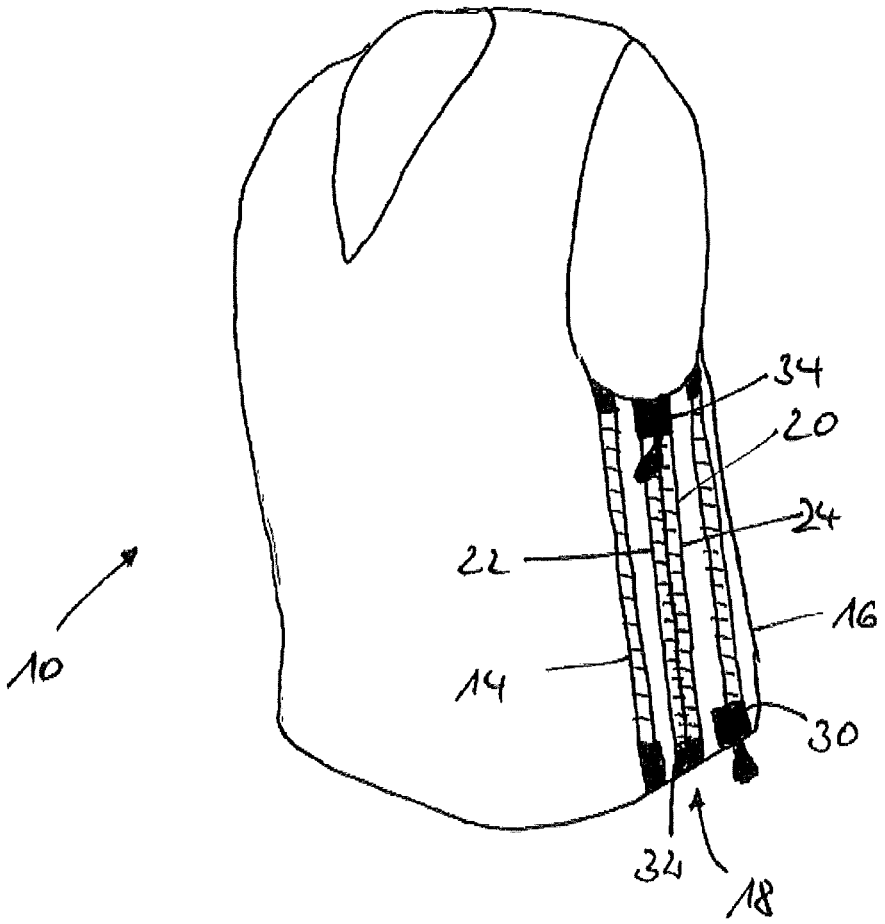
FIG. 2 shows a garment according to the invention in a second state.

When the outer zipper 12 is opened by moving the slider 30 toward the end piece 28 the image shown in FIG. 2 is obtained. The rows of teeth 14, 16 of the outer zipper 12 are now spaced apart while being connected or held together at a distance by the material 18. A particularity of the present example is that the material 18 between the rows of teeth 14, 16 includes an inner zipper 20 which in turn comprises two rows of teeth 22, 24, an end piece 32 and a slider 34. The inner zipper 20 is sewn into the garment 10 in the same orientation as the outer zipper 12. This is in no way required. Any orientation and any combination of orientations are within the framework of the present invention.

If the two states of the garment shown in FIGS. 1 and 2 are compared it becomes obvious that the garment 10 has different sizes in the two states, the garment being smaller in the state according to FIG. 1 in which the outer zipper 12 is closed than in the state according to FIG. 2 in which the outer zipper 12 is opened.

Figure 3:
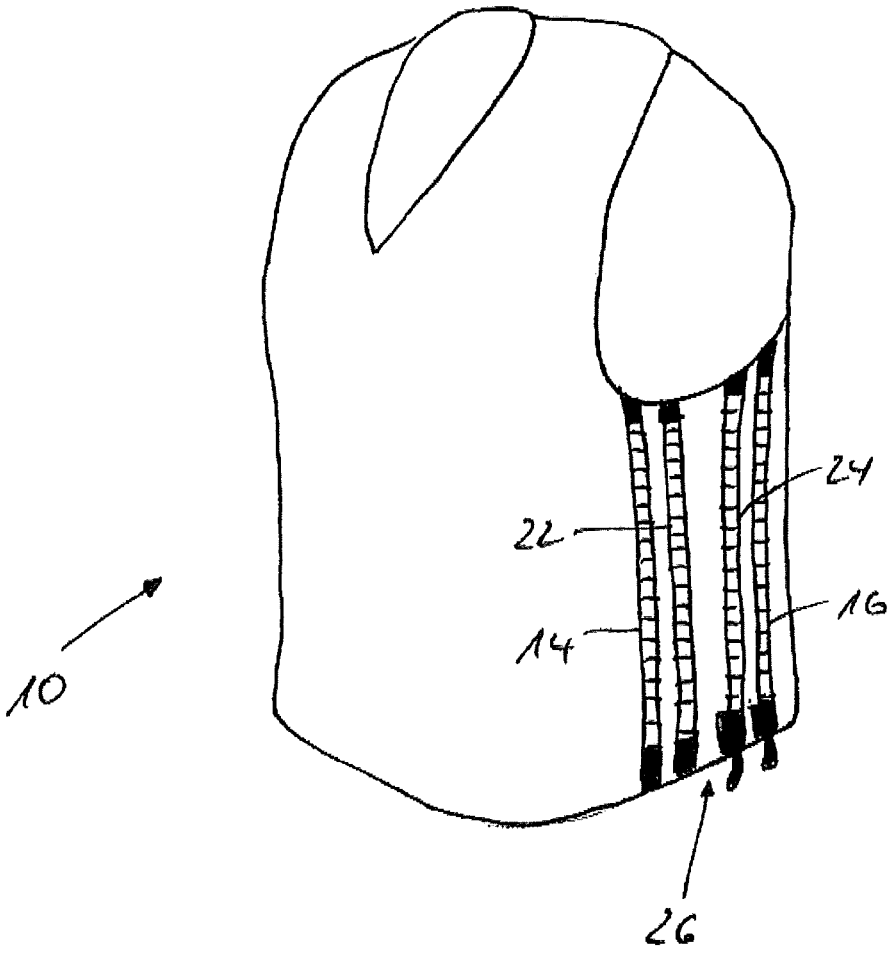
FIG. 3 shows a garment according to the invention in a third state.

Now, FIG. 3 shows another state of the garment 10. Here, the inner zipper 20 with its rows of teeth 22, 24 is also opened. The rows of teeth 22, 24 of the inner zipper 20 are also held together at a distance by the material 26. With the state illustrated in FIG. 3 now a third size of the garment 10 is realised, in addition to the two sizes illustrated in FIGS. 1 and 2.

Figure 4:
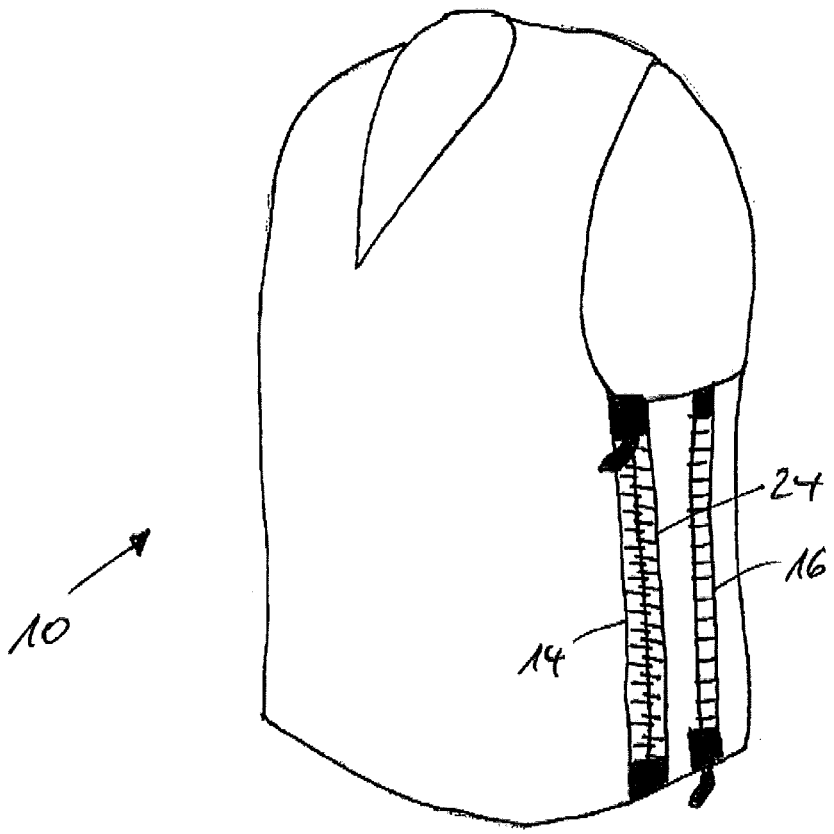
FIG. 4 shows a garment according to the invention in a fourth state.

However, it is also possible to realise further sizes with the present zipper arrangement. This will be explained in connection with FIG. 4. In the state illustrated here, the row of teeth 24 of the inner zipper 20 is coupled with the row of teeth 14 of the outer zipper. This results in an intermediate size ranging between the sizes the garment 10 has according to FIGS. 1 and 2. It would likewise be possible, starting from the state illustrated in FIG. 3, to couple the row of teeth 22 of the inner zipper 20 to the row of teeth 16 of the outer zipper 12.

With the aid of FIG. 2, another aspect of the present invention can be explained. FIG. 2 shows a complete zipper 20 which is exposed when the outer zipper 12 is opened. Likewise, however, it would be possible to, for example, provide only a single row of teeth instead of the complete zipper 20. This single row of teeth may then be coupled with one of the rows of teeth 14, 16 of the outer zipper 12 to realise an intermediate size in this way as well.

Another variant of the present invention can be explained with reference to FIG. 3. Here it is contemplated that the material 26 between the rows of teeth 22, 24 of the inner zipper has no specific particularities. It may simply be the textile fabric of which the remaining garment 10 also fully or partly consists. However, it would, again, also be possible to provide yet another zipper in the area of the material 26 which would then have a functional relationship with the inner zipper 20 comprising the rows of teeth 22, 24 like the inner zipper 20 has with the outer zipper 12. Likewise, of course, also only a single row of teeth or a plurality of independent rows of teeth may be provided between the rows of teeth 22, 24 of the inner zipper 20.

The thus described nesting of zippers or rows of teeth may be continued as desired so that finally a multitude of zippers together form the zipper arrangement.

The described zipper arrangement as a whole may be offered as a textile component. The textile component will then be sewn into a garment like a single zipper.

In the embodiment described above only a single zipper arrangement is shown. Preferably a zipper arrangement which may be identical or different in design as compared to the described zipper arrangement is also present on the other side of the garment, namely below the other arm opening. Likewise, it might be contemplated to provide zipper arrangements between the lower edge of the garment and the head opening, be it in the breast and/or in the back area. Zipper arrangements may also extend horizontally, for example between the two arm openings. In this way, the length of a garment may be varied.

The features of the invention disclosed in the above description, in the drawings, as well as in the claims may be essential for the implementation of the invention individually as well as in any combination.

LIST OF NUMERALS

10 garment
12 outer zipper
14 row of teeth
16 row of teeth
18 material
20 inner zipper
22 row of teeth
24 row of teeth
26 material
28 end piece
30 slider
32 end piece
34 slider

The invention claimed is:

1. A garment which is adjustable in its size, wherein at least one outer zipper having two rows of teeth is provided, wherein the garment has a first size in a closed state of the at least one outer zipper and a second size in an opened state of the at least one outer zipper, wherein the first size is smaller than the second size, and wherein, in the opened state of the at least one outer zipper, the rows of teeth are held together at a distance by material at least partly covered by the at least one outer zipper in the closed state of the at least one outer zipper, wherein an inner zipper having two rows of teeth is provided which is at least partly covered by the at least one outer zipper in the closed state of the at least one outer zipper and which is exposed in the opened state of the at least one outer zipper, and in that the garment has the second size in a closed state of the inner zipper and a third size in the opened state of the inner zipper, the second size being smaller than the third size, and wherein, in the opened state of the inner zipper, the rows of teeth of the inner zipper are held together at a distance by a material at least partly covered by the inner zipper in the closed state of the inner zipper, and wherein, in the opened state of the zippers the rows of teeth are completely separated from each other.

2. The garment according to claim 1, wherein at least one of the rows of teeth of the at least one outer zipper is coupled with at least one of the rows of teeth of the inner zipper in the way of a zipper in the opened state of the at least one outer zipper and in the opened state of the inner zipper.

3. The garment according to claim 1, wherein another inner zipper having two rows of teeth is provided or in that a plurality of other inner zippers having two rows of teeth are provided, wherein respectively adjacent inner zippers are interrelated like the at least one outer zipper and the inner zipper directly following the at least one outer zipper.

4. The garment according to claim 1, further comprising at least one additional rows of teeth connectable with either the inner zipper or the at least one outer zipper.

5. The garment according to claim 1, wherein a zipper arrangement is formed by the at least one outer zipper and the inner zipper and/or the rows of teeth and in that zipper arrangements are provided in a plurality of positions of the garment.

6. The garment according to claim 1, wherein the garment is configured as a protective vest.

7. A garment which is adjustable in its size, comprising:

a first row of teeth, a second row of teeth, a third row of teeth and a fourth row of teeth spaced apart from one another in order and in series along a portion of the garment, wherein the first row of teeth is mateable to form a zipper with the third row of teeth and the fourth row of teeth, wherein the second row of teeth and the third row of teeth are covered when the first row of teeth is mated with the fourth row of teeth, wherein the second row of teeth is covered when the first row of teeth is mated with the third row of teeth, wherein the second row of teeth is mateable to form a zipper with the third row of teeth, wherein the third row of teeth is mateable to form a zipper with the first row of teeth and the second row of teeth, wherein the fourth row of teeth is mateable to form a zipper with the first row of teeth wherein the second row of teeth and third row of teeth are covered when mated, the garment having, a first garment size when all the rows of teeth are not mated, a second garment size, which is smaller than the first garment size, when the second row of teeth is mated with the third row of teeth, a third garment size, which is smaller than the first garment size, when the first row of teeth is mated with the third row of teeth, a fourth garment size, which is smaller than the first garment size, the second garment size and the third garment size, when the first row of teeth is mated with the fourth row of teeth.

8. The garment of claim 7, wherein the garment is configured as a protective vest.

9. The garment of claim 7, wherein the second and the third size are equal.

* * * * *